US011396774B2

(12) United States Patent
Chambers et al.

(10) Patent No.: US 11,396,774 B2
(45) Date of Patent: Jul. 26, 2022

(54) STEERING ACTUATION MECHANISM

(71) Applicant: Halliburton Energy Services, Inc., Houston, TX (US)

(72) Inventors: Larry DeLynn Chambers, Castro Valley, CA (US); Lizheng Zhang, Humble, TX (US); Neelesh Deolalikar, Houston, TX (US); Wei Zhang, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/014,806

(22) Filed: Sep. 8, 2020

(65) Prior Publication Data

US 2021/0087885 A1 Mar. 25, 2021

Related U.S. Application Data

(60) Provisional application No. 62/905,800, filed on Sep. 25, 2019.

(51) Int. Cl.
*E21B 7/06* (2006.01)

(52) U.S. Cl.
CPC ..... *E21B 7/061* (2013.01); *E21B 7/06* (2013.01)

(58) Field of Classification Search
CPC ..... E21B 7/061; E21B 7/062; E21B 7/067
See application file for complete search history.

(56) References Cited

U.S. PATENT DOCUMENTS 3,875,634 A * 4/1975 Minegishi ..... B23P 15/06 29/888.074
5,402,858 A * 4/1995 Quantz ..... E21B 10/25 175/228
5,553,678 A * 9/1996 Barr ..... E21B 47/01 175/73

(Continued)

FOREIGN PATENT DOCUMENTS

WO WO-2013143024 A1 10/2013
WO WO-2019133034 A1 7/2019
WO WO-2019133036 A1 7/2019

OTHER PUBLICATIONS

Korean Intellectual Property Office, International Search Report and Written Opinion, PCT/US2020/049745, dated Dec. 10, 2020, 12 pages, Korea.

*Primary Examiner* — Christopher J Sebesta
*Assistant Examiner* — Lamia Quaim
(74) *Attorney, Agent, or Firm* — Haynes and Boone, LLP

(57) ABSTRACT

Steering mechanisms for use in RSS systems may be devoid of an elastomeric piston seal. Pistons of the steering mechanisms have a convex cross-section that permit the piston to pivot along with a steering pad while moving laterally or radially along a piston axis defined by a piston bore. Hydraulic pressure may be maintained as the pad is extended since a limited gap size between the piston and the bore may be maintained throughout the motion of the pistons. The pistons may be retained to the steering pad in a T-slot and may be elongated in a direction orthogonal to the axis of the piston bore. A groove may be provided around the piston for a receiving a back-up seal therein. The back-up seal may include wear resistant balls embedded in a matrix, and balls may be preloaded to serve as flow restrictors even when worn.

20 Claims, 10 Drawing Sheets

(56) References Cited

U.S. PATENT DOCUMENTS

| | | | | |
|---|---|---|---|---|
| 8,157,024 | B2 | 4/2012 | De Paula Neves et al. | |
| 8,474,552 | B2 | 7/2013 | De Paula Neves et al. | |
| 2006/0157283 | A1 | 7/2006 | Hart | |
| 2006/0185902 | A1* | 8/2006 | Song | E21B 7/06 175/61 |
| 2016/0002978 | A1* | 1/2016 | Rushton | E21B 7/06 175/61 |
| 2016/0326805 | A1 | 11/2016 | Gao | |
| 2018/0128060 | A1* | 5/2018 | Haugvaldstad | E21B 7/06 |
| 2019/0128071 | A1* | 5/2019 | Conger | E21B 17/1014 |

* cited by examiner

STEERING ACTUATION MECHANISM

CROSS-REFERENCE TO RELATED APPLICATION(S)

This application claims priority to U.S. Provisional Application No. 62/905,800 filed Sep. 25, 2019, entitled "Steering Actuation Mechanism," the disclosure of which is hereby incorporated by reference.

BACKGROUND

The present disclosure relates generally to rotary steerable systems (RSS), e.g., drilling systems employed for directionally drilling wellbores in oil and gas exploration and production. More particularly, embodiments of the disclosure relate to mechanisms for extending a pad of the rotary steerable system to thereby steer the RSS through a geologic formation.

Directional drilling operations involve controlling the direction of a wellbore as it is being drilled. Usually the goal of directional drilling is to reach a target subterranean destination with a drill string, and often the drill string will need to be turned through a tight radius to reach the target destination. Generally, an RSS changes direction either by extending a steering pad to push against one side of a wellbore with a steering force to thereby cause the drill bit to push on an opposite side of the wellbore (in a push-the-bit system), or by bending a main shaft running through a non-rotating housing to point the drill bit in a particular direction with respect to the rest of the tool (in a point-the-bit system). In a push-the-bit system, the steering pads may be actuated by hydraulic pistons that extend reciprocate in a piston bore defined in a housing of the RSS. Elastomeric seal members are often provided to establish a seal between the piston and the housing, but these seal members often have a limited service life due to the harsh downhole environment in which these seal members are employed.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure relates to steering mechanisms for use in RSS systems that do not require an elastomeric piston seal. The steering mechanisms may include pistons having a convex cross-section with respect to an axis of a piston bore. The pistons permit hydraulic pressure to be applied due to a limited gap size between the piston and the bore, e.g., between a widest portion of the convex cross-section of the piston and an adjacent wall of the piston bore. The pistons may be retained to a steering pad, which may reduce impact forces associated with applying and relieving the hydraulic pressure. The pistons may be elongated in a direction orthogonal to the axis of the piston bore, which reduces a leak flow area for a given cross-sectional area of the piston. A groove may be provided around the piston for a receiving a back-up seal therein. The back-up seal may include wear resistant particles or balls embedded in a matrix, and the particles or balls may be preloaded to serve as flow restrictors even when worn. The pistons may include skirt that is elongated on one lateral side thereof, which may discourage tilting of the piston within a piston bore. The pistons may also include a pocket in which a ball or roller is retained to engage the steering pad.

Figure 1:
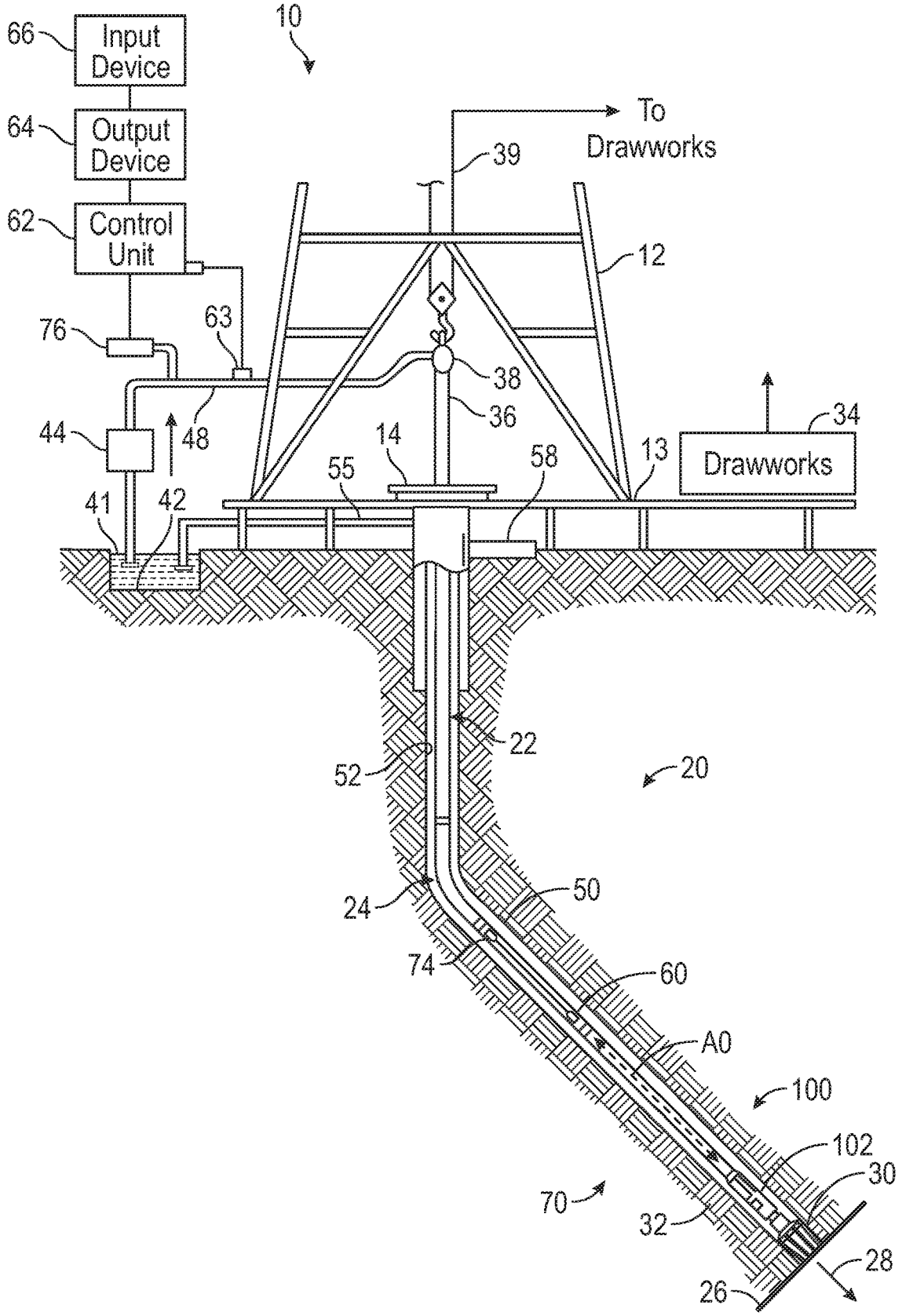
FIG. 1 is a partial cross-sectional side view of a directional drilling system including an RSS according to example embodiments of the disclosure.

Referring to FIG. 1, a directional drilling system 10 includes an RSS 100. The directional drilling system 10 is illustrated including a tower or "derrick" 12 that is buttressed by a derrick floor 13. The derrick floor 13 supports a rotary table 14 that is driven at a desired rotational speed, for example, via a chain drive system through operation of a prime mover (not shown). The rotary table 14, in turn, is operable to provide rotational force to a drill string 20. The drill string 20, which includes a drill pipe section 22, extends downwardly from the rotary table 14 into a directional borehole 24. The borehole 24 may exhibit a multi-dimensional path or "trajectory." The three-dimensional direction of the bottom 26 of the borehole 24 of FIG. 1 is represented by arrow 28.

A drill bit 30 is attached to the distal, downhole end of the drill string 20. When rotated, e.g., via the rotary table 14, the drill bit 30 operates to break up and generally disintegrate the geological formation 32. The drill string 20 is coupled to a "drawworks" hoisting apparatus 34, for example, via a kelly joint 36, swivel 38, and line 39 through a pulley system (not shown). During a drilling operation, the drawworks 34 can be operated, in some embodiments, to control the weight on drill bit 30 and the rate of penetration of the drill string 20 into the borehole 24.

During drilling operations, a suitable drilling fluid 41 or "mud" can be circulated, under pressure, out from a mud pit 42 and into the borehole 24 through the drill string 20 by a hydraulic "mud pump" 44. Drilling fluid 41 passes from the mud pump 44 into the drill string 20 via a fluid conduit (commonly referred to as a "mud line") 48 and the kelly joint 36. The mud 31 is discharged at the borehole bottom 26 through an opening or nozzle in the drill bit 30, and circulates in an "uphole" direction towards the surface through an annular space 50 between the drill string 20 and the side 52 of the borehole 24. As the drilling fluid 41 approaches the rotary table 14, it is discharged via a return line 55 into the mud pit 42. A variety of surface sensors 58, which are appropriately deployed on the surface of the borehole 24, operate alone or in conjunction with downhole sensors 60 deployed within the borehole 24, to provide information about various drilling-related parameters, such as fluid flow rate, weight on bit, hook load, etc.

A surface control unit 62 may receive signals from surface sensors 58 and downhole sensors, 60 and other devices via a sensor or transducer 63, which can be placed on the mud line 48. The surface control unit 62 can be operable to process such signals according to programmed instructions provided to surface control unit 62. Surface control unit 62 may present to an operator desired drilling parameters and other information via one or more output devices 64, such as a display, a computer monitor, speakers, lights, etc., which may be used by the operator to control the drilling operations. Surface control unit 62 may contain a computer, memory for storing data, a data recorder, and other known and hereinafter developed peripherals. Surface control unit 62 may also include models and may process data according to programmed instructions, and respond to user commands entered through a suitable input device 66, which may be in the nature of a keyboard, touchscreen, microphone, mouse, joystick, etc.

In some embodiments of the present disclosure, the rotatable drill bit 30 is attached at a distal end of a bottom hole assembly (BHA) 70 including the rotary steerable system (RSS) 100. The RSS 100 includes steering pads 102 for steering the drill bit 30 through the formation 32, and thereby defining the trajectory of the borehole 24. The steering pads 102 may be extendable in a lateral direction from a longitudinal axis A of the RSS 100 to push against the geologic formation 32. The extent to which each of a plurality of radially spaced steering pads 102 are extended may be adjustable to assist in controlling the direction of the borehole 24. In some embodiments, the RSS 100 may include a stabilizer (not shown) at a proximal or uphole end thereof. The BHA 70 and/or RSS 100 can provide some or all of the requisite force for the bit 30 to break through the geologic formation 32, e.g., "weight on bit" and torque for turning the drill bit 30, and provide the necessary directional control for drilling the borehole 24.

The BHA 70 and or/the RSS 100 may comprise a Measurement While Drilling (MWD) System and/or a Logging While Drilling (LWD) System, with various sensors to provide information about the formation 32 and downhole drilling parameters. The MWD and or LWD sensors in the BHA 70 may include, but are not limited to, a device for measuring the formation resistivity near the drill bit, a gamma ray device for measuring the devices for determining the inclination and azimuth of the drill string, and pressure sensors for measuring drilling fluid pressure downhole. The MWD System may also include additional/alternative sensing devices for measuring shock, vibration, torque, telemetry, etc. The above-noted devices may transmit data to a downhole communicator 74, which in turn transmits the data uphole to the surface control unit 62.

The transducer 63 can be placed in the mud line 48 to detect the mud pulses responsive to the data transmitted by the downhole communicator 74. The transducer 63 in turn generates electrical signals, for example, in response to the mud pressure variations and transmits such signals to the surface control unit 62. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. A surface transmitter/receiver 76 communicates with downhole tools using, for example, any of the transmission techniques described, such as a mud pulse telemetry technique. This can enable two-way communication between the surface control unit 62 and the downhole communicator 74 and other downhole tools.

Figure 2A:
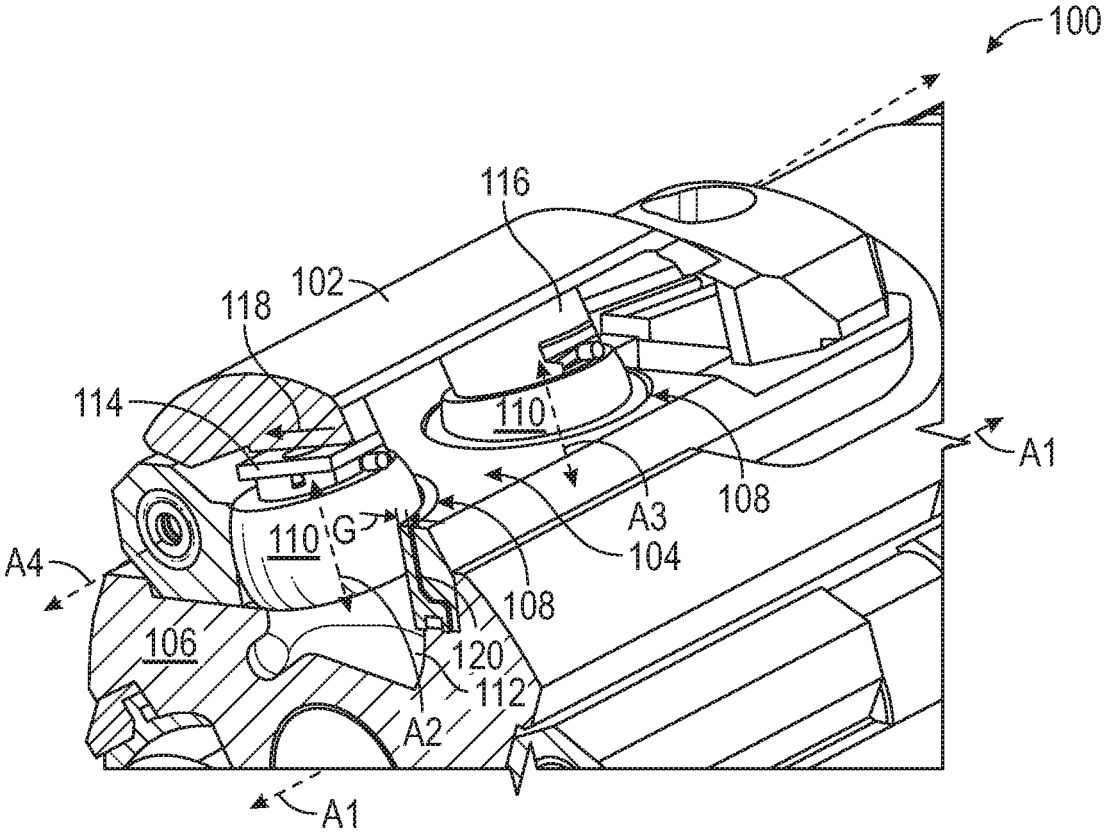
FIGS. 2A and 2B are partial, cross-sectional views of a steering actuation mechanism of the RSS of FIG. 1 in extended (FIG. 2A) and retracted (FIG. 2B) configurations illustrating a pair of seal-less pistons retained to a steering pad with freedom of movement along one axis with respect to the steering pad.
Figure 2B:
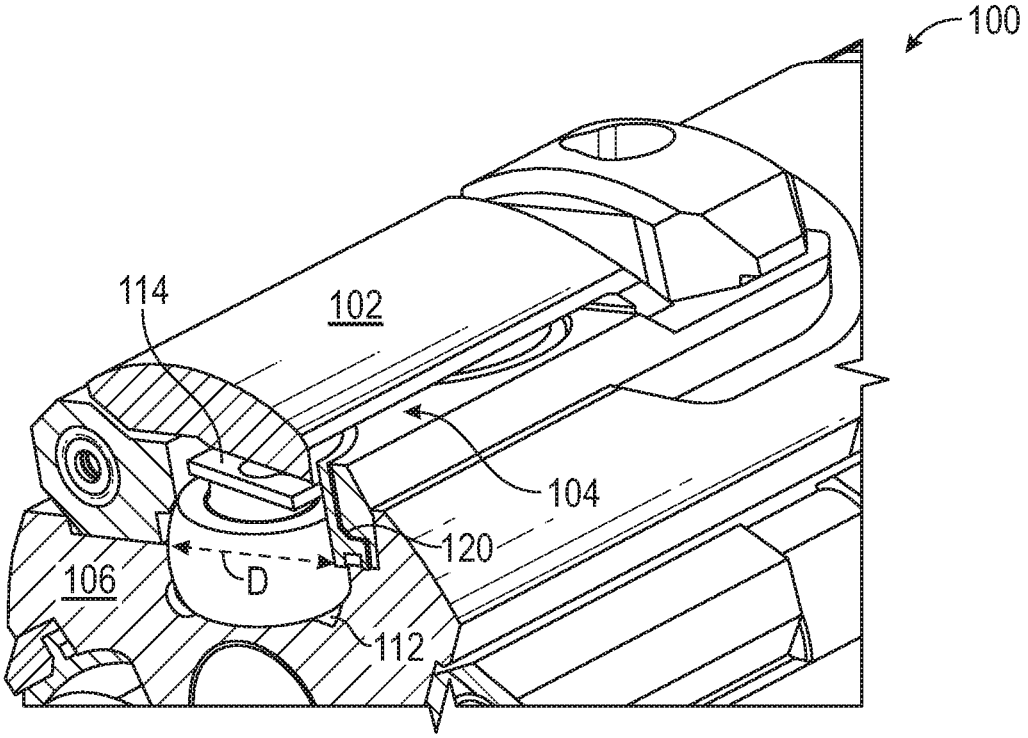

Referring to FIGS. 2A and 2B, the RSS 100 includes a steering pad 102, which is extendable in a lateral direction by a steering actuation mechanism 104. The RSS 100 includes a housing 106 defining a longitudinal axis A1. The housing 106 includes a pair of piston bores 108, which may be generally straight extending along respective piston axes A2, A3 in a lateral direction with respect to the longitudinal axis A1. The steering pad 102 is pivotally coupled to the housing 106 about a pivot axis A4, which may be generally parallel to the longitudinal axis A1. A piston 110 is disposed within each of the piston bores 108 and is movable along the respective piston axis A2, A3. A hydraulic chamber 112 is defined in the housing 106 adjacent each of the pistons 110, which may be selectively pressurized to extend the pistons 110 radially from the piston bores 108 as illustrated in FIG. 2A. The pistons 110 push on the steering pad 102 to pivot the steering pad 102 radially outwardly about the pivot axis A4. Relieving the hydraulic pressure from the hydraulic chamber 112 permits the pistons 110 and steering pad 102 to return to radially retracted positions with respect to the housing 106 as illustrated in FIG. 2B. A gap "G" is defined between each of the piston 110 and the piston bore, the gap extending along the piston bore from the hydraulic chamber to an exterior of the housing The pistons 110 include each include a T-shaped flange 114 projecting from a radially outward surface of the piston 110. The flanges 114 provide a broad bearing area across which the pistons 110 press against the steering pad 102 to pivot the steering pad 102 radially outward. The flanges 114 are received in a T-slot 116 defined in the steering pad 102, which retains the pistons 110 with respect to the steering pad 102. As the steering pad 102 pivots, the T-slots 116 permit the steering pad 102 to move along the pistons 110 in a direction 118 obliquely arranged with respect to the piston axes A2 and A3. The direction 118 is orthogonal to the pivot axis A4 of the steering pad. The pistons 110 define a convex cross-section in a plane through the piston axes A2, A3, which in some embodiments may be arcuate such that the pistons 110 generally define a spherical or ball-shaped portion. A diameter "D" across a widest portion of the pistons 110 may be closely fit with a bearing 120 in the piston bores 108 to retain hydraulic fluid within the hydraulic chambers 112. The close fit permits hydraulic pressure to accumulate sufficiently without a sealing member closing a gap "G" between the pistons 110 and the bearings 120 such that the pistons 110 may extend with the steering force that provides the necessary directional control for drilling the borehole 24. For example, in some embodiments, the gap "G" may have a width of about less than 0.003 inches may be provided between the pistons 110 and a wall of the bearings 120. The gap "G" extends along the piston bores 108 between the hydraulic chamber 112 and an exterior of the housing 106. The arcuate shape of the pistons 110 permit the pistons 110 to pivot along with the steering pad 102 while maintaining a close fit with the bearing 120. The close fit restricts fluid flow through the gap "G" such that fluid pressure may accumulate in the hydraulic chamber 112 to extend the pistons 110. The bearings 120 (or the piston bores 108) may be constructed of carbide, metallic or ceramic materials, with or without coatings thereon.

In operation, the pistons 110 remain retained to the steering pad 102 such that the pistons 110 do not subject the steering pad 102 to impact forces as the hydraulic chambers 112 are pressurized. Similarly, the hydraulic chambers 112 are not subject to impact loads from the pistons 110 when hydraulic pressure in the hydraulic chambers 112 is relieved. The T-slots 116 also provide a degree of freedom for the pistons 110 to slide along the steering pad 102. The sliding motion allows the pistons 110 to readily pivot while moving along the pivot axes A2, A3 without jamming.

Figure 2C:
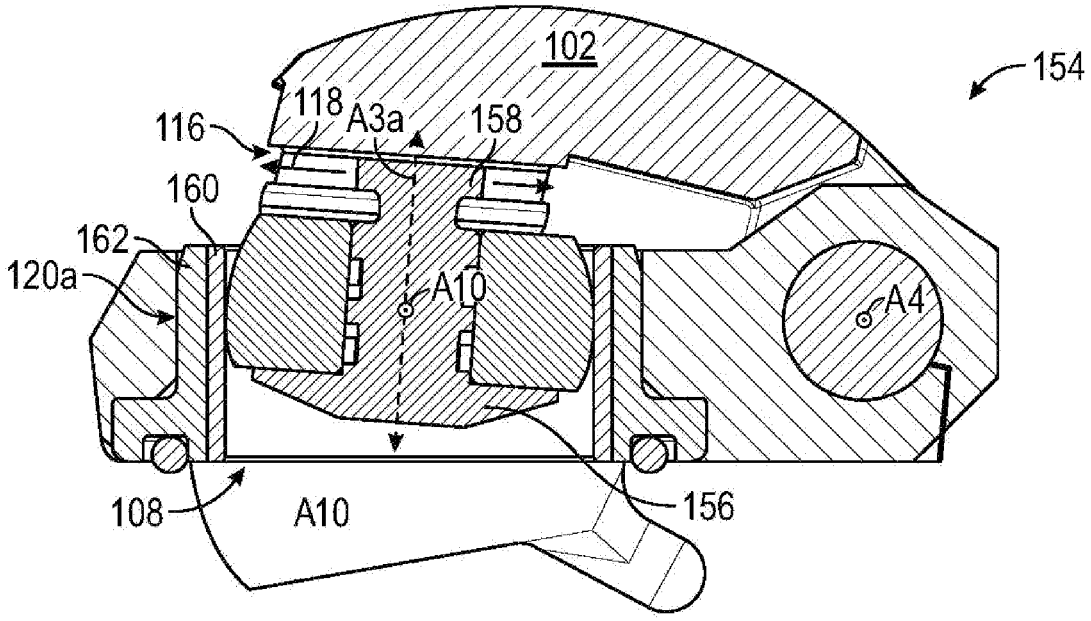
FIGS. 2C to 2E are partial, cross-sectional and perspective views of another embodiment of a steering actuation mechanism in extended (FIGS. 2C and 2E) and retracted (FIG. 2D) configurations illustrating a pair of seal-less pistons retained to a steering pad with freedom of movement along an axis with respect to the steering pad, as well as with freedom of rotation about an axis through the piston.
Figure 2D:
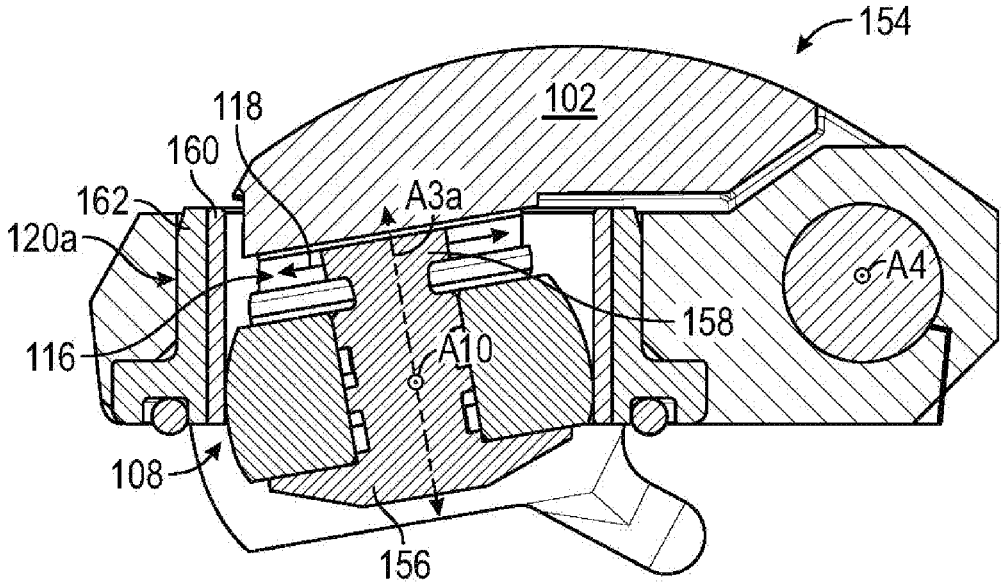
Figure 2E:
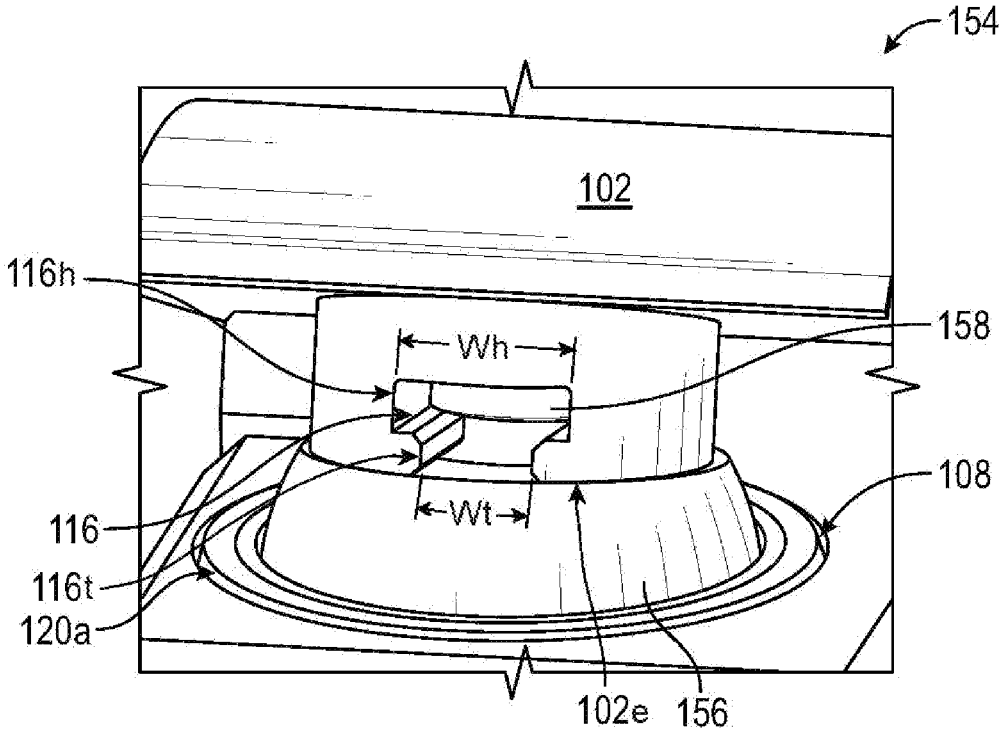
Figure 2F:
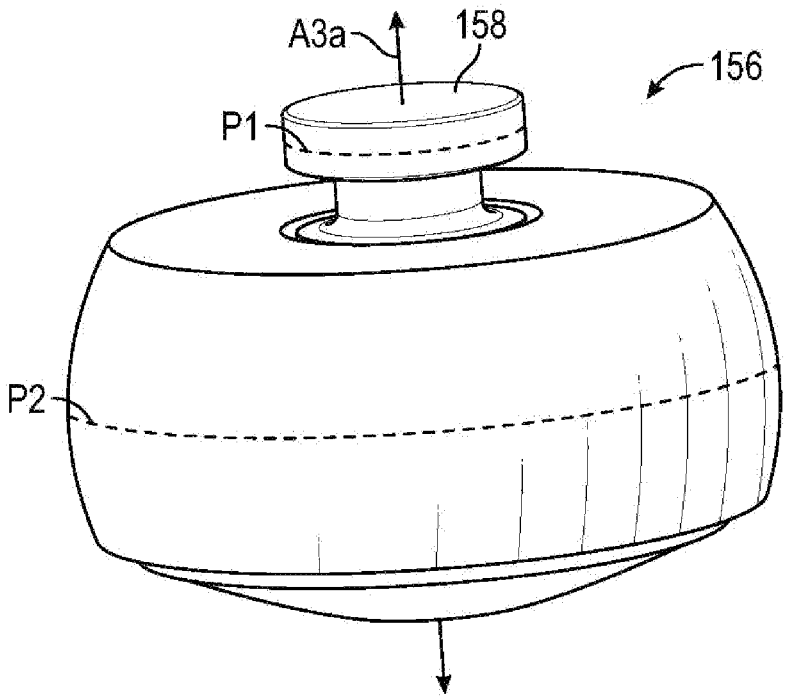
FIG. 2F is a perspective view of the piston of FIGS. 2C to 2E.

Referring to FIGS. 2C, 2D and 2E, a steering actuation mechanism 154 is illustrated that provides one additional degree of freedom for a piston 156 than the steering actuation mechanism 104 shown in FIGS. 2A and 2B. The T-slot 116 defines a throat 116*t* extending to an exterior surface 102*e* of the steering pad 102 and a head space 116*h* spaced from the exterior surface 102*e*. The throat 116*t* defines a throat width "Wt" less than a head-space width "Wh" defined by the head space 116*h* (see FIG. 2E). The piston 156 can be free to rotate around its rotational axis A3*a* as well as sliding in the direction 118 in the T-slots 116 (FIG. 2A). This freedom to rotate about axis A3 a reduces the abrasive wear between the piston 156 and piston bore 108 and/or bearings 120 a, as well as allow for more uniform erosion wear of the piston 156. As illustrated in FIGS. 2E and 2F, the piston 156 includes a generally circular flange 158 at an upper end thereof. The flange 158 may rotate within the T-slot 116 of the steering pad 102 while guiding the relative movement in the direction 118 between the piston 156 and the steering pad 102. The free rotational movement about the axis A3 a permits frictional wear to be distributed about a perimeter P1 (FIG. 2F) of the circular flange 158 and a perimeter P2 (FIG. 2F) around an arcuate portion of the piston 156 that engages the piston bore 108. Similar to the piston 110 described above, the piston 156 defines a convex cross-section permitting the piston 156 to freely pivot within the piston bore 108 about an axis A10 parallel to the pivot axis 104 of the at least one steering pad 102.

Figure 3:
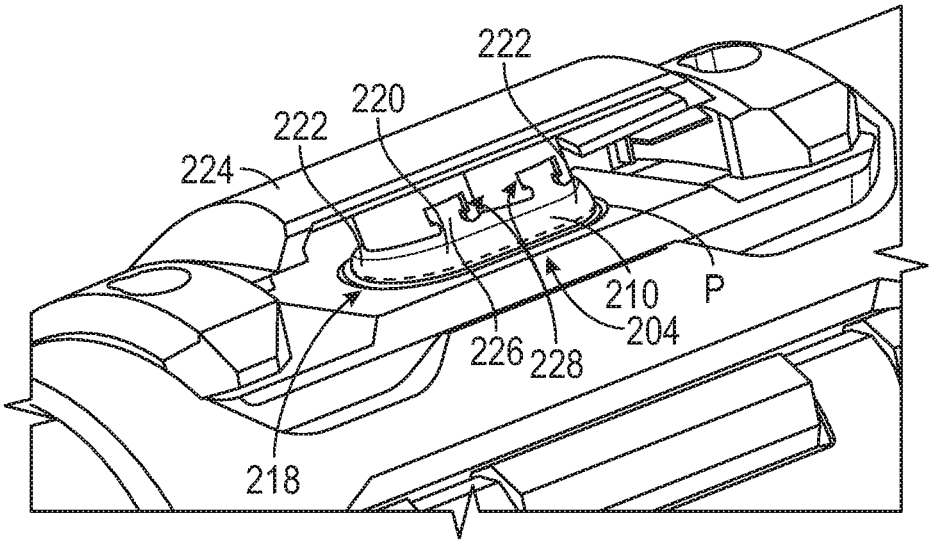
FIG. 3 is a partial, perspective view of another embodiment of a steering actuation mechanism including a single elongated piston retained to a steering pad.

Also shown in FIGS. 2C and 2D, a bearing 120*a* in the piston bore 108 is constructed of two layers of material. An inner layer 160 may be constructed of a material having high erosion/abrasion resistance such as tungsten carbide, ceramic, polycrystalline diamond, etc. An outer layer 162 may be constructed of a material having high fracture toughness such as stainless steel, titanium alloys, etc. Referring to FIG. 3, a steering mechanism 204 includes a single piston 210 extending from an elongated cylindrical piston bore 218. The piston 210 is elongated and generally spherocylindrical or capsule-shaped, having a generally cylindrical medial portion 220 and spherical ends 222. The piston 210 is retained to a steering pad 224 by flanges 226 of the piston 210 slidably received in a pair of T-slots 228 defined in the steering pad 224. The piston 210 may operate substantially similarly to the pair of pistons 110 (see FIG. 2A) and may provide a reduced leak flow area for a given piston area and a similar gap distance. For example, a combined perimeter of the two spherical pistons 110 each having a 1.5-inch diameter would be 9.42 inches with a total cross-sectional area of 3.534 $in^2$ across the piston bores 108. The perimeter P1 of a spherocylindrical piston 210 having the same cross-sectional area across the piston bore 218 would be 7.07 inches. Since the perimeter P1 is about 25% less than the combined perimeter of the two spherical pistons 110, for an equally sized gap defined between the pistons 110, 210, about a 25% reduction in the leak flow area may be achieved by providing a spherocylindrical piston 210. In other embodiments (not shown) a single piston or a plurality of pistons retained to a steering pad may be a prolate spheroid and a corresponding piston bore may be an elliptical cylinder.

Figure 4:
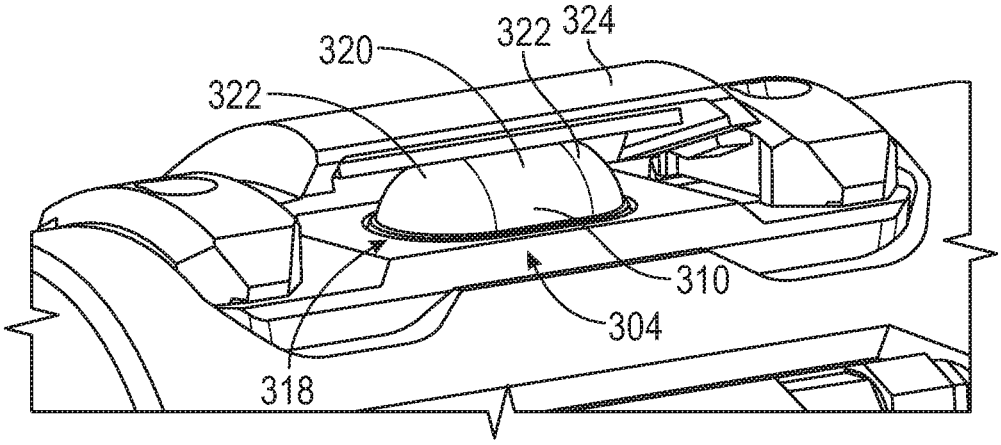
FIG. 4 is a partial, perspective view of another embodiment of a steering actuation mechanism including an elongated cylindrical piston disconnected from a steering pad.

Referring to FIG. 4, a steering actuation mechanism 304 includes a piston 310 extending from a piston bore 318. Similar to the piston 210 (FIG. 3), the piston 310 is elongated and generally spherocylindrical or capsule-shaped, having a generally cylindrical medial portion 320 and spherical ends 322. Unlike the piston 210 the piston 310 may not be retained to a steering pad 324. Rather, the piston 310 may engage the steering pad 324 when moved to the radially extended position illustrated by a hydraulic force. The piston 310 may roll in against the steering pad 324 as the steering pad 324 pivots. When the hydraulic force is relieved, the piston 310 may disengage the steering pad 324 and move to a radially retracted position within the piston bore 318. The piston 310 provides a reduced leak flow area compared to a plurality of ball shaped pistons having a similar cross-sectional area. In other embodiments (not shown) a single piston or a plurality of pistons detached from an associated steering pad may be a prolate spheroid and a corresponding piston bore may be an elliptical cylinder.

Figure 5A:
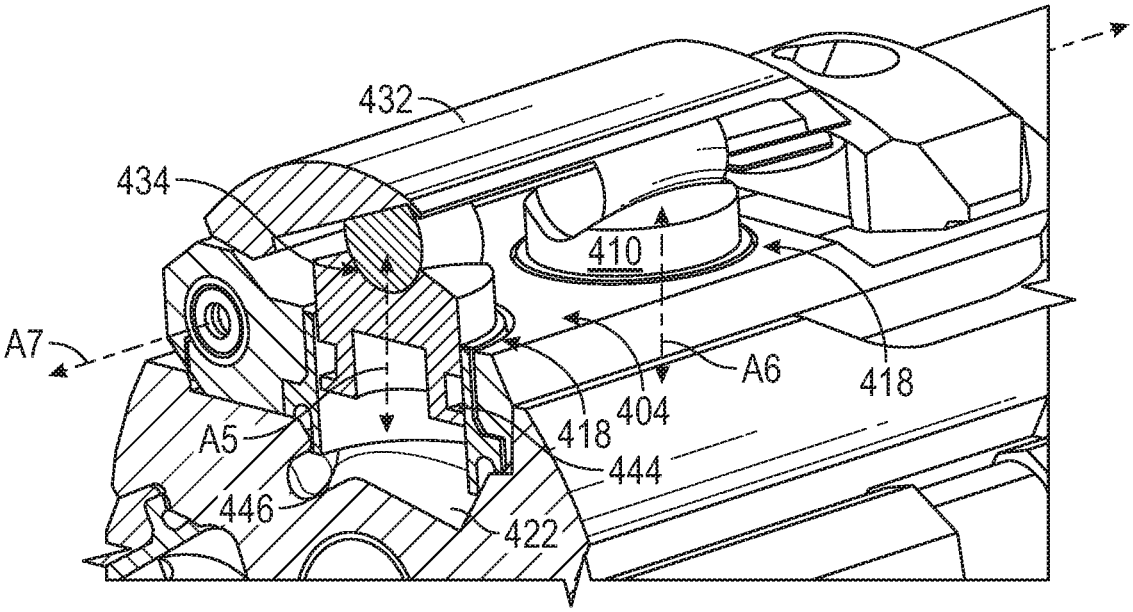
FIGS. 5A and 5B are partial, cross-sectional views of another embodiment of a steering actuation mechanism in extended (FIG. 5A) and retracted (FIG. 5B) configurations illustrating a pair of generally cylindrical pistons including a groove that may receive an elastomeric seal therein.
Figure 5B:
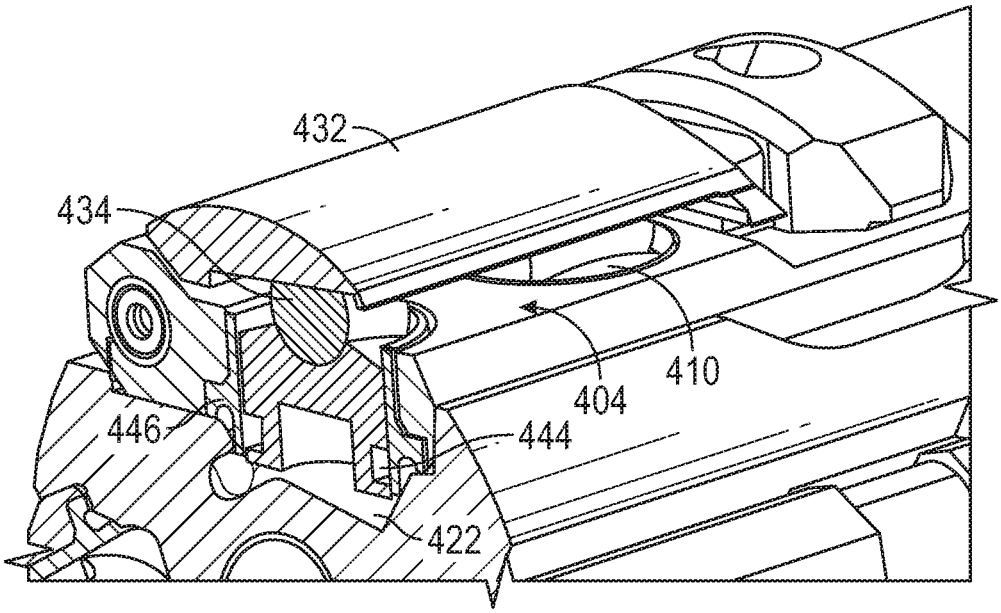

Referring to FIGS. 5A and 5B, a steering actuation mechanism 404 includes a pair of pistons 410 extending from respective piston bores 418. The pistons 410 and the piston bores 418 are generally cylindrical in shape extending along piston axes A5, A6 in a lateral direction. Hydraulic chambers 422 are defined in the piston bores adjacent each of the pistons 410, which may be selectively pressurized to extend the pistons 410 radially from the piston bores 418 as illustrated in FIG. 5A. The pistons 410 push on the steering pad 432 to pivot the steering pad 432 radially outwardly about the pivot axis A7. A cylindrical roller is 434 provided between the piston 410 and the steering pad 432 to facilitate pivotal motion of the steering pad 432 in response to lateral extension of the pistons 410. The cylindrical roller 434 may be retained in a slot 434 of the steering pad 432 and may maintain rolling contact between the pistons 410 and the steering pad 432 as hydraulic pressure is applied and relieved from a hydraulic chamber 422. Relieving the hydraulic pressure from the hydraulic chamber 422 permits the pistons 410 and steering pad 432 to return to radially retracted position as illustrated in FIG. 5B. The pistons 410 each include a circumferential groove 444 therearound that may receive an elastomeric or other seal member therein (see, e.g., FIGS. 6A, 6B and 6C). The elastomeric seal member establishes a sealing relation with a bearing 446 disposed with in the piston bores 418. In other embodiments, a groove may be provided around any of the pistons 110, 210 or 310 described above to provide a back-up to the close fit of the respective piston 110, 210 or 310.

Figure 6A:
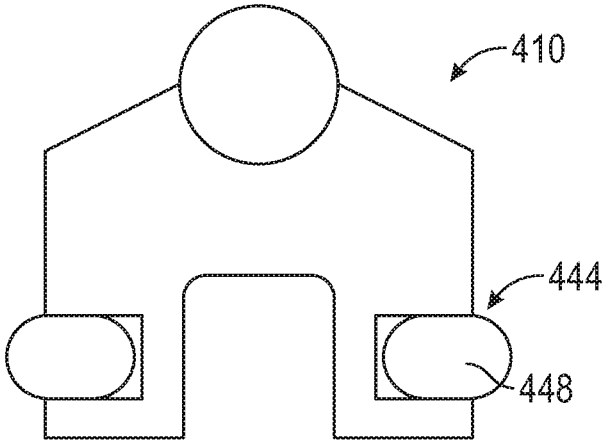
FIGS. 6A, 6B and 6C are cross-sectional views of the cylindrical piston of FIGS. 5A and 5B including various seal members received within the groove.
Figure 6B:
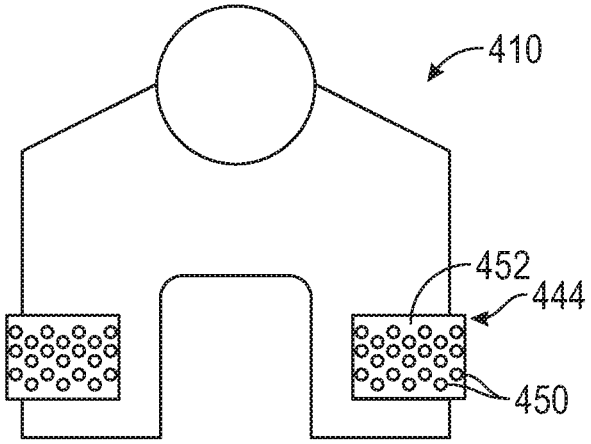
Figure 6C:
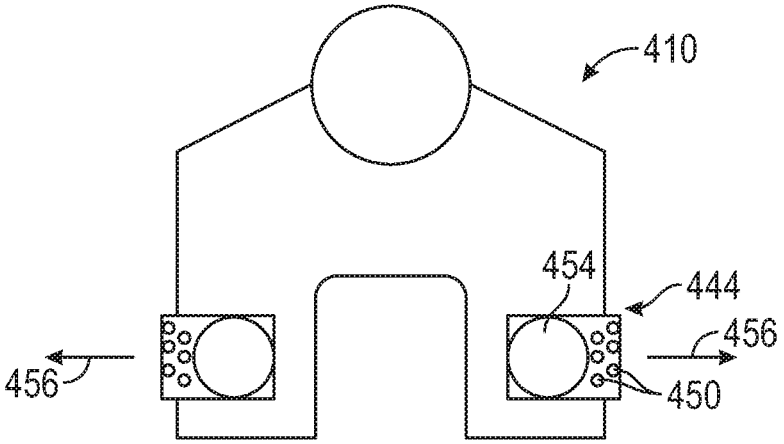

Referring to FIGS. 6A, 6B and 6C, the piston 410 is illustrated with at least one seal member disposed therein. The groove 444 may receive a single elastomeric o-ring 448 as illustrated in FIG. 6A. Alternatively, as illustrated in FIG. 6B, the groove 444 may be filled with wear resistant particles or balls 450 therein constructed of carbide, ceramics, diamond or other wear resistant materials. The interstitial spaces defined between the balls 450 may be filled with a filler material 452 such as grease or a rubber matrix in which the balls 450 are suspended.

As illustrated in FIG. 6C, the balls 450 may be preloaded or energized so as to keep functioning as the balls 450 are worn. For example, as illustrated in FIG. 6C a spring 454 may be provided within the groove 444 to bias the balls 450 radially outward, e.g., in the direction of arrows 456. The spring 454 biases the balls 450 into contact with the bearing 446 (see FIGS. 5A and 5B). The spring 454 may be a metallic spring or a compressed elastomer. In other embodiments, a fluid pressure may be applied to the groove 444 to press the balls 450 into contact with the bearing 446.

Figure 7A:
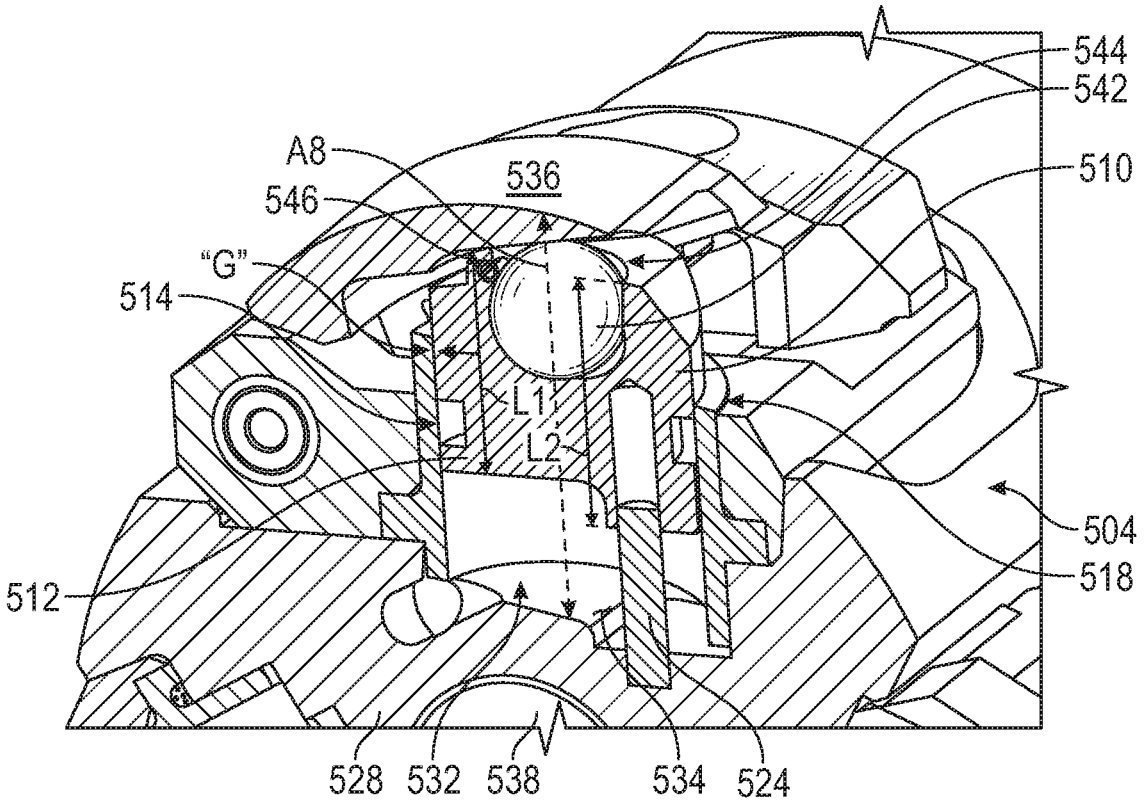
FIGS. 7A and 7B are partial, cross-sectional views of another embodiment of a steering actuation mechanism in extended (FIG. 7A) and retracted (FIG. 7B) configurations illustrating a keyed piston having an extended skirt on a lateral side of the piston and a ball retained on the piston in rolling contact with a steering pad.
Figure 7B:
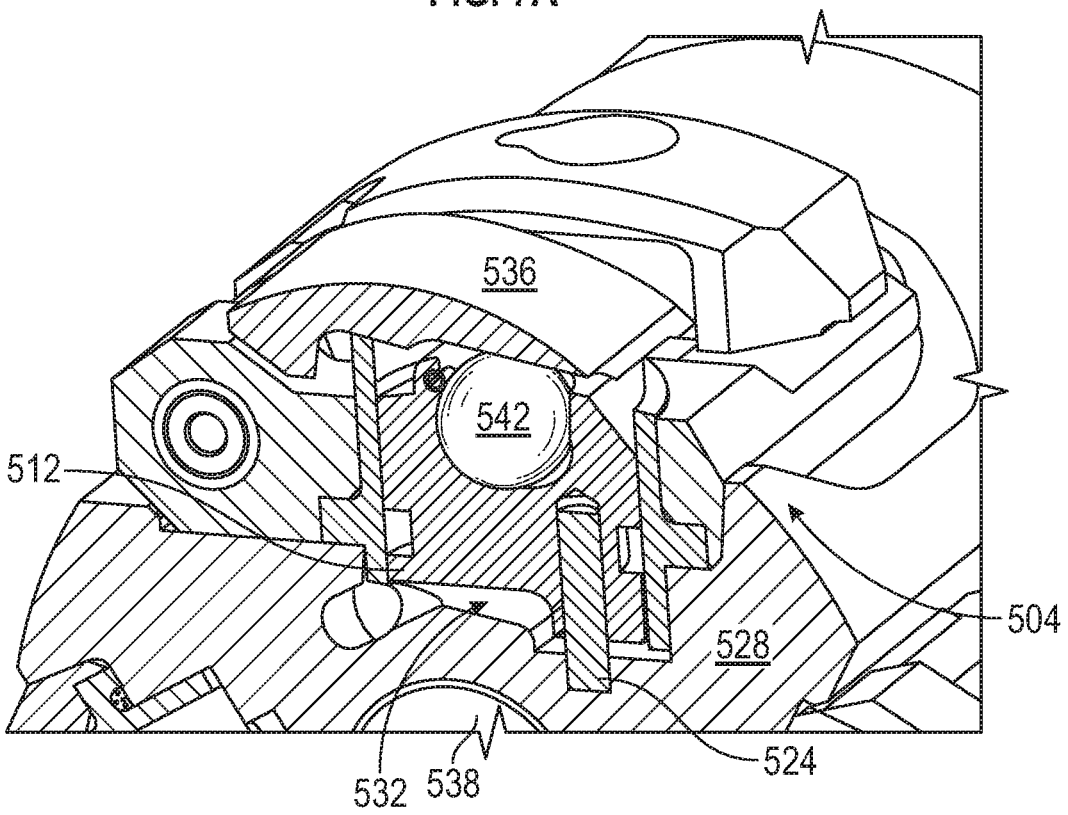

Referring now to FIGS. 7A and 7B, a steering actuation mechanism 504 includes at least one piston 510 extending from a piston bore 518. The piston 510 includes a skirt 512 that extends below a circumferential groove 514 defined around the piston 510. The skirt 512 is elongated on one lateral side thereof such that the piston 510 defines a first length L1 on a first lateral side thereof and a greater second length L2 defined on a second lateral side thereof. Since a circumferential gap "G" may be defined between the piston 510 and the piston bore 518 about a perimeter of the piston 510, the greater length L2 may operate to prevent tilting of the piston 510 within the piston bore 518. Thus, the grater length L2 maintains the piston 510 in general alignment with piston axis A8.

A key 524 is provided between housing 528 and the piston 510 to maintain a rotational orientation of the of the piston 510 about the piston axis A8. In the retracted configuration of FIG. 7B, the skirt 512 extends into a hydraulic chamber 532 having a stepped floor 534. The key 524 prevents the skirt 512 from impacting the stepped floor 534 in an orientation (not shown) that could prevent the piston 510 from reaching the retracted position of FIG. 7B where a steering pad 536 is fully closed. The stepped floor 534 accommodates the elongated skirt 512 within the limited space available in the housing 528, e.g., without interfering with a longitudinal flow bore 538 extending through the housing 528.

The piston 510 includes a ball 542 retained in a pocket 544 of the piston 510 by a pin 546. The ball 542 rotates against a steering pad 536 as the piston 510 moves between the extended (FIG. 7A) and retracted (FIG. 7B) positions in the piston bore 518. Retaining the ball 542 in the piston 510 may reduce impact loads of the ball 542 engaging the steering pad 536.

Figure 8A:
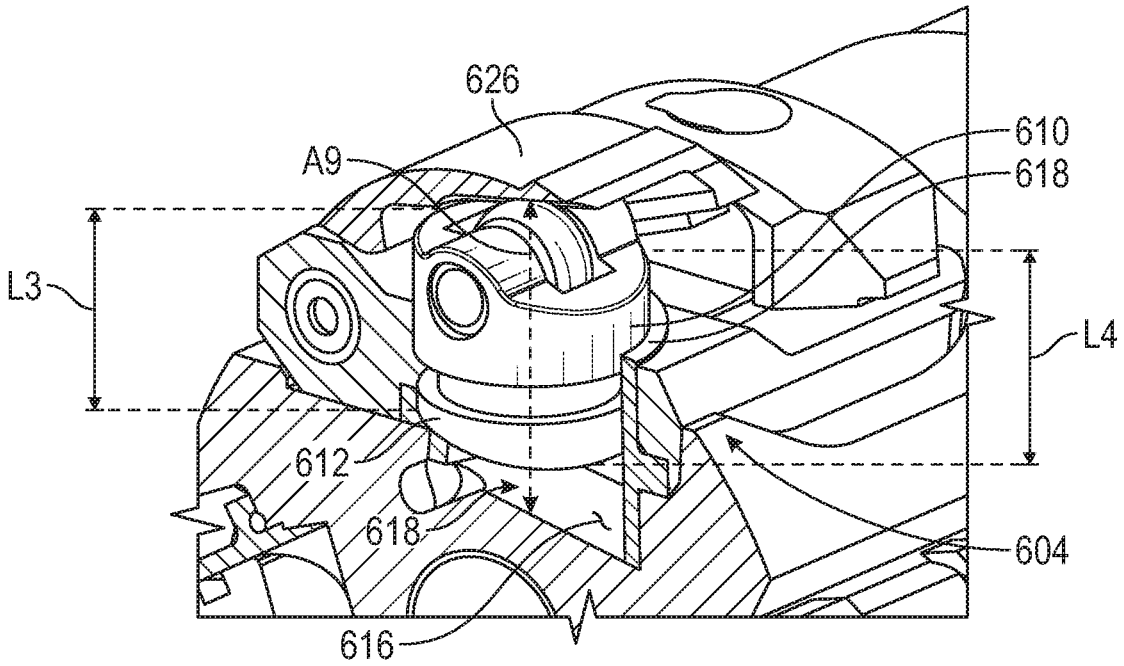
FIGS. 8A and 8B are partial, cross-sectional views of another embodiment of a steering actuation mechanism in extended (FIG. 8A) and retracted (FIG. 8B) configurations illustrating a piston having an angled skirt and a roller ball retained by an axel on the piston.
Figure 8B:
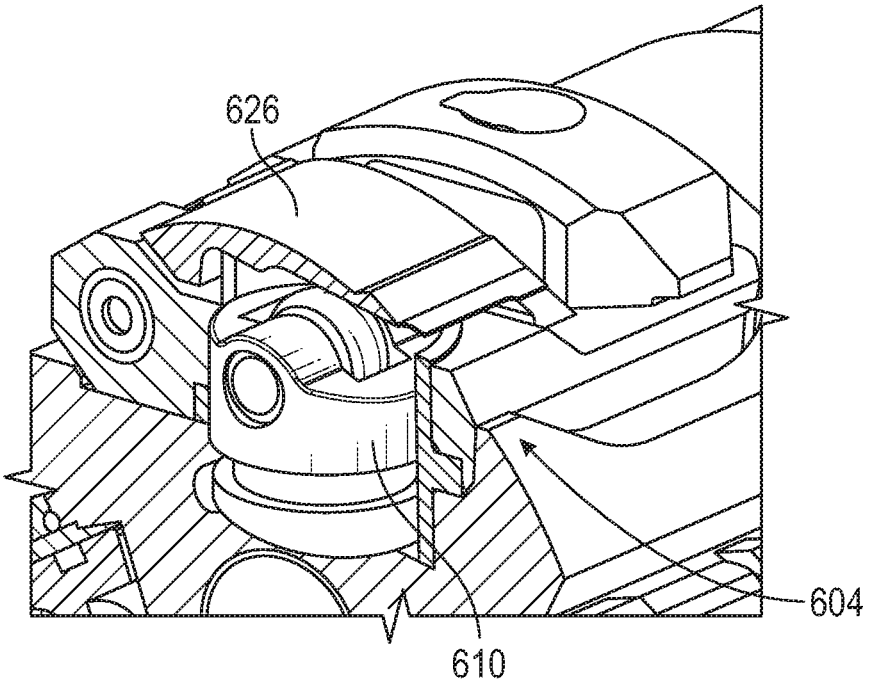

Referring now to FIGS. 8A and 8B, a steering actuation mechanism 604 includes at least one piston 610 extending from a piston bore 618. The piston 610 has an angled or sloped skirt 612 such that the piston 610 defines a length L3 on one first lateral side thereof and a greater length L4 defined on a second lateral side thereof. The sloped skirt 612 may facilitate maintaining a rotational orientation of the piston 610 about piston axis A9. The skirt 612 may engage a flat or sloped floor 616 of a hydraulic chamber 618 to orient the piston 610.

Figure 8C:
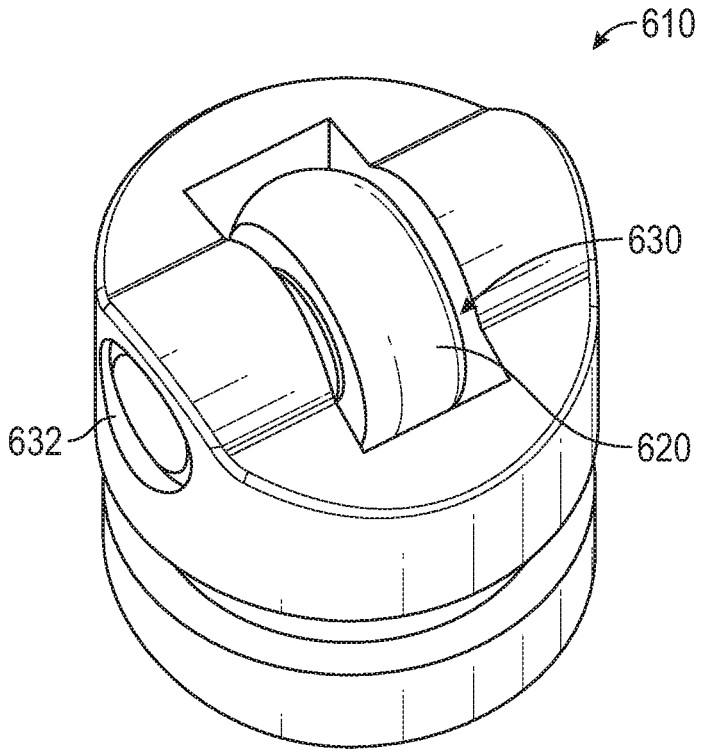
FIG. 8C is a perspective view of the piston of FIGS. 8A and 8B.

A roller 620 on the piston 610 is provided to roll against a steering pad 626 as the piston 610 moves between the extended (FIG. 8A) and retracted (FIG. 8B) positions in the piston bore 618. As illustrated in FIG. 8C, the roller 620 is retained in a pocket 630 defined in the piston 610 by an axel 632 extending through the roller 620. The axle 632 and a convex outer diameter of the roller 620 facilitates rolling of the roller 620 in a single plane with respect to the piston 610. The arrangement of the roller 620 may also facilitate maintaining the piston 610 in a particular rotational orientation about the piston axis A9.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to a first aspect, the disclosure is directed to a rotary steerable apparatus. The rotary steerable apparatus includes a housing defining a longitudinal axis and having at least one piston bore extending from a hydraulic chamber within the housing along a piston axis oriented in a lateral direction with respect to the longitudinal axis of the housing. A drill bit is supported at a distal end of the housing and at least one steering pad is laterally extendable from the housing to thereby urge the housing in an opposite lateral direction in a wellbore. At least one piston is movable within the at least one piston bore in response to an increase in hydraulic pressure within the hydraulic chamber to thereby laterally extend the at least one steering pad. A gap defined between the at least one piston and the piston bore, the gap extending along the piston bore from the hydraulic chamber to an exterior of the housing.

In one or more embodiments, the at least one piston defines a convex cross-section in a plane extending through the piston axis. The convex cross-section of the at least one piston may be generally circular such that the at least one piston includes a generally spherical portion.

In some embodiments, the steering pad is pivotably coupled to the housing about a pivot axis generally parallel to the longitudinal axis. The at least one piston may be retained to the at least one steering pad and selectively movable between radially retracted and extended positions along the piston axis. The at least one piston may be retained in a T-slot defined on the steering pad, the at least one piston movable with respect to the steering along the T-slot in an oblique direction with respect to the piston axis. The at least one piston may be retained in the T-slot by a circular flange of the piston, and the circular flange may be rotatable in the T-slot such that the at least one piston is rotatable about the piston axis.

In one or more embodiments, the at least one piston includes a pair of pistons spaced from one another along the longitudinal axis. In some embodiments, the at least one piston includes a circumferential groove receiving at least one seal member therein. The at least one seal member may include at least one of the group consisting of an elastomeric o-ring, a plurality of wear resistant particles embedded in a filler material and a plurality of wear resistant particles suspended in grease. The at least one seal member may include a plurality of wear resistant particles energized by a spring to be biased radially outward with respect to the circumferential groove. In some embodiments, the at least one piston bore is at least one of the group consisting of cylindrical, elongated cylindrical and elliptically cylindrical, and wherein the at least one piston is at least one of the group consisting of spherical, spheroidal and spherocylindrical.

In another aspect, the disclosure is directed to a steerable drilling system. The steerable drilling system includes drill string extending from a surface location into a borehole, the drill string operable to rotate about a longitudinal axis of the drill string. A housing is supported within the drill string, the housing defining a hydraulic chamber therein and at least one piston bore extending from the hydraulic chamber. A drill bit is supported at a distal end of the housing, and at least one steering pad is pivotably coupled to the housing and extendable laterally from the housing to engage a side of the borehole and thereby urge the housing in an opposite lateral direction. At least one piston is selectively extendable through the at least one piston bore in the lateral direction and in engagement with the at least one steering pad to urge the steering pad to pivot radially outward from the housing. A gap is defined along the piston bore between the at least one piston and the housing about a perimeter of the at least one piston.

In some embodiments, the at least one piston is retained to the at least one steering pad and is slidable along the steering pad in an oblique direction as the steering pad pivots. In some embodiments, at least one piston is disconnected from the at least one steering pad. The steerable drilling system may further included a roller retained on the at least one pad and rollable between the at least one pad and the at least one piston as the at least one piston is extended.

In one or more embodiments, the at least one piston defines an arcuate convex cross-section in a plane through a piston axis extending in the lateral direction. The at least one piston may include a skirt elongated on one lateral side thereof such that the at least one piston defines a greater length along a first lateral side than an opposite lateral side thereof. The skirt is sloped between the first lateral side and the opposite lateral side of the at least one piston. In some embodiments, the skirt is stepped between the first lateral side and the opposite lateral side of the at least one piston, and the piston may be keyed to the housing such that the piston maintains a rotational orientation with respect to the housing. In some embodiments, the at least one piston includes at least one of the group consisting of a ball retained in a pocket defined in the at least one piston, the ball rotatable against the at least one steering pad and a roller retained in a pocket defined in the at least one piston, the roller retained in the pocket to rotate in a single plane with respect to the piston.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A rotary steerable apparatus, comprising:

a housing defining a longitudinal axis and having at least one piston bore extending from a hydraulic chamber within the housing along a piston axis oriented in a lateral direction with respect to the longitudinal axis of the housing;

a drill bit supported at a distal end of the housing;

at least one steering pad pivotally coupled to the housing about a pivot axis such that the at least one steering pad is laterally extendable from the housing to thereby urge the housing in an opposite lateral direction in a wellbore, the at least one steering pad defining a slot therein extending in a direction orthogonal to the pivot axis;

at least one piston movable within the at least one piston bore in response to an increase in hydraulic pressure within the hydraulic chamber to thereby pivot and laterally extend the at least one steering pad, the at least one piston including a flange engaged with the slot of the at least one steering pad, the flange slidable along the slot in the direction orthogonal to the pivot axis as the at least one steering pad pivots; and a gap defined between the at least one piston and the piston bore, the gap extending along the piston bore from the hydraulic chamber to an exterior of the housing.

2. The rotary steerable apparatus according to claim 1, wherein the at least one piston defines a convex cross-section in a plane extending through the piston axis, wherein the convex cross-section defines a diameter extending across the piston bore such that the convex cross-section defines a close fit with the piston bore.

3. The rotary steerable apparatus according to claim 2, wherein the convex cross-section of the at least one piston is generally circular such that the at least one piston includes a generally spherical portion pivotable within the piston bore while maintaining the close fit with the piston bore.

4. The rotary steerable apparatus according to claim 1, wherein the pivot axis is generally parallel to the longitudinal axis of the housing.

5. The rotary steerable apparatus according to claim 4, wherein the at least one piston is retained to the at least one steering pad and selectively movable between radially retracted and extended positions along the piston axis.

6. The rotary steerable system according to claim 5, wherein the slot is a T-slot having a throat extending to an exterior surface of the at least one pad and a head-space from the exterior surface, the throat defining a throat width less than a head-space width defined by the head space, and wherein the flange of the at least one piston is retained in the T-slot, the at least one piston movable with respect to the steering pad along the T-slot in the direction orthogonal to the pivot axis.

7. The rotary steerable system according to claim 6, wherein the flange of the at least one piston is circular, wherein the at least one piston is retained in the T-slot by the circular flange of the piston, and wherein the circular flange is rotatable in the T-slot such that the at least one piston is rotatable about the piston axis.

8. The rotary steerable system according to claim 1, wherein the at least one piston includes a pair of pistons spaced from one another along the longitudinal axis.

9. The rotary steerable system according to claim 1, wherein the at least one piston bore is at least one of the group consisting of cylindrical, elongated cylindrical and elliptically cylindrical, and wherein the at least one piston is at least one of the group consisting of spherical, spheroidal and spherocylindrical.

10. A steerable drilling system, comprising:

a drill string extending from a surface location into a borehole, the drill string operable to rotate about a longitudinal axis of the drill string;

a housing supported within the drill string, the housing defining a hydraulic chamber therein and at least one piston bore extending from the hydraulic chamber;

a drill bit supported at a distal end of the housing;

at least one steering pad pivotably coupled to the housing and extendable laterally from the housing to engage a side of the borehole and thereby urge the housing in an opposite lateral direction, the at least one steering pad defining a slot therein extending in a direction orthogonal to a pivot axis of the steering pad; and at least one piston selectively extendable through the at least one piston bore in the lateral direction and where the at least one piston includes a flange in slidable engagement with the slot of the at least one steering pad to urge the steering pad to pivot radially outward from the housing as the flange slides along the slot in the direction orthogonal to the pivot axis, and wherein a gap is defined along the piston bore between the at least one piston and the housing about a perimeter of the at least one piston.

11. The steerable drilling system according to claim 10, wherein the at least one piston is retained to the at least one steering pad by the engagement of the flange with a head-space defined by the slot, wherein the head space exhibits a width greater than a throat defined by the slot, the throat extending to an exterior surface of the at least one steering pad.

12. The steerable drilling system according to claim 10, wherein the at least one piston defines an arcuate convex cross-section in a plane through a piston axis extending in the lateral direction, wherein the arcuate convex cross-section defines a diameter at a widest portion of the piston and wherein the widest portion of the pistons is disposed within the at least one piston bore.

13. The rotary steerable apparatus according to claim 3, wherein the close fit is defined by a width of the gap of about 0.003 inches or less.

14. The rotary steerable apparatus according to claim 13, wherein the close fit is defined between the at least one piston and a bearing defining a wall of the piston bore.

15. The steerable drilling system according to claim 10, wherein the at least one steering pad includes a plurality of steering pads radially spaced around the housing.

16. A rotary steerable apparatus, comprising:

a housing defining a longitudinal axis and having at least one piston bore extending from a hydraulic chamber within the housing along a piston axis oriented in a lateral direction with respect to the longitudinal axis of the housing;

at least one steering pad pivotally coupled to the housing about a pivot axis such that the at least one steering pad is laterally extendable from the housing to thereby urge the housing in an opposite lateral direction in a well-bore, the at least one steering pad defining a slot therein extending in a direction orthogonal to the pivot axis; and at least one piston within the at least one piston bore and movable in the lateral direction in response to an increase in hydraulic pressure within the hydraulic chamber, the at least one piston coupled to the at least one steering pad with a flange freely slidable along the slot in a direction orthogonal to the pivot axis and the piston defining an arcuate cross-section permitting the piston to freely pivot within the piston bore about an axis parallel to the pivot axis of the at least one steering pad.

17. The rotary steerable apparatus according to claim 16, wherein the flange is circular to permit free rotation of the flange within the slot about a piston axis defined by the piston.

18. The rotary steerable apparatus according to claim 16, wherein the slot is a T-slot having a throat extending to an exterior surface of the at least one pad and a head-space from the exterior surface, the throat defining a throat width less than a head-space width defined by the head space.

19. The rotary steerable apparatus according to claim 16, wherein the piston is elongated in a direction orthogonal to the piston axis.

20. The rotary steerable apparatus according to claim 19, wherein the piston is generally spherocylindrical having a generally cylindrical medial and spherical ends.

* * * * *